United States Patent [19]

Lenk et al.

[11] Patent Number: 4,584,977

[45] Date of Patent: Apr. 29, 1986

[54] LOW ENGINE OIL SENSING SWITCH

[75] Inventors: Michael Lenk, Toledo; Richard S. Podiak, Maumee, both of Ohio

[73] Assignee: Champion Spark Plug Company, Toledo, Ohio

[21] Appl. No.: 718,312

[22] Filed: Apr. 1, 1985

Related U.S. Application Data

[63] Continuation-in-part of Ser. No. 605,350, Apr. 30, 1984, Pat. No. 4,522,170.

[51] Int. Cl.[4] ..... F01M 1/00

[52] U.S. Cl. ..... 123/196 S; 123/198 DC; 184/108; 73/116

[58] Field of Search ..... 123/196 S, 198 DC; 184/6.4, 108; 73/115; 116/227

[56] References Cited

U.S. PATENT DOCUMENTS

| | | | |
|---|---|---|---|
| 2,529,775 | 11/1950 | Maddox | 123/196 S |
| 2,600,810 | 6/1952 | Lucas | 123/198 DC |
| 3,366,100 | 1/1968 | Sapp | 123/198 DC |
| 3,487,183 | 12/1968 | Schulman | 123/198 DC |
| 4,203,408 | 5/1980 | Yamaguchi et al. | 123/198 DC |
| 4,429,670 | 2/1984 | Ulanet | 123/198 D |

*Primary Examiner*—E. Rollins Cross

*Attorney, Agent, or Firm*—Oliver E. Todd, Jr.

[57] ABSTRACT

A pneumatic switch (25) responsive to the vacuum in a closed crankcase (20) of a reciprocating piston engine (15) for indicating when there is less than a predetermined quantity of oil (21) in the crankcase. The switch includes a housing (30) defining a cylinder (35), a closed end (48) and an open end (74). A piston (36) reciprocates and rotates in the cylinder through a path determined by a cam (51) and a follower (52). Crankcase vacuum is applied to a chamber (47) between the piston and the closed housing end to move the piston against a calibrated spring (50). An electric switch (70, 71 and 76) indicates when the piston is in the portion of its path of motion when the engine is operating and there is less than the predetermined quantity of oil in the crankcase.

12 Claims, 11 Drawing Figures

LOW ENGINE OIL SENSING SWITCH

CROSS REFERENCE TO RELATED APPLICATION

This is a continuation in part of our copending United States patent application Ser. No. 605,350 filed Apr. 30, 1984 for a Low Engine Oil Sensing Method now U.S. Pat. No. 4,522,170.

TECHNICAL FIELD

The invention relates to a switch for sensing oil level in an operating engine and more particularly to a pneumatically actuated switch for sensing when the quantity of oil present in the crankcase of an operating reciprocating piston engine is insufficient for proper lubrication.

BACKGROUND ART

A four-stroke reciprocating piston internal combustion engine has a crankcase which is partially filled with a lubricating oil. In one type of engine, a pump circulates the oil under pressure to lubricate different moving parts of the engine. A loss of oil pressure is easily monitored to automatically stop the engine or to alert an operator in the event that there is insufficient oil in the crankcase. In another type of engine, the oil in the crankcase is highly agitated or splashed about to lubricate the moving engine parts.

If the quantity of oil within the engine crankcase decreases through leakage or oil consumption by the engine, the engine may be damaged by inadequate lubrication. In smaller engines and particularly single cylinder engines of the type having splash lubrication rather than forced lubrication, the lubricating oil is constantly agitated and some of the oil will be coated on the surfaces within the crankcase. The small size of the crankcase and the constant agitation of the oil makes crankcase oil level sensing extremely difficult during engine operation using prior art techniques since there is no constant pool of oil having a distinct surface. Also, for many engine applications, such as in lawn mowers, the engine may be tilted during operation. This further complicates the problem of measuring the oil surface level. Engines of this type rely upon the engine operator checking the oil level prior to starting the engine and, if the engine is operated for long periods of time, periodically stopping the engine to check the oil level. Damage to many small engines due to insufficient lubrication could be prevented if reliance on this human factor were eliminated.

For many small engines, electronic oil sensors are not practical due to the cost factor. Many small engines are manually started and use a magneto or a magneto powered electronic ignition system for generating an ignition voltage. There is no generator or alternator and battery present on the engine for operating electronic circuits, such as an electronic oil level sensing system, if such a system were developed. The cost of adding a generator or alternator and a battery to a manually started small engine plus the cost of an electronic oil volume sensor may render the engine unsalable for many applications.

DISCLOSURE OF THE INVENTION

In a conventional reciprocating piston internal combustion engine, crankcase gases are vented to prevent a positive pressure buildup in the crankcase as one or more pistons reciprocate. If the crankcase is sealed, the gas pressure within the crankcase will pulsate with a vacuum to pressure swing as the piston reciprocates and will eventually build up to a pulsating positive pressure due to combustion gases blowing by the piston rings. As a consequence of any positive pressure in the crankcase, during a portion of each combustion chamber operating cycle the crankcase will have a higher pressure than the combustion chamber and some crankcase oil may be forced past the piston rings into the combustion chamber where it is burned. More importantly, the positive pressure may force oil past the crankshaft seals. In order to eliminate this problem, a check valve, typically of the reed type, is provided for venting above atmospheric pressure gases from the crankcase. The stroking of the piston in conjunction with the pressure relief valve results in primarily a cyclic subatmospheric pressure or an average vacuum within the crankcase.

We have found that the average magnitude of the vacuum within the crankcase of the operating engine is translatable to the total quantity of oil in the crankcase. This is due to the fact that the reciprocating piston has a fixed displacement and the volume of gas within the crankcase is an inverse function of the quantity of oil in the crankcase. As the quantity of crankcase oil decreases, the volume of gas in the crankcase will increase to replace the lost oil. Since the piston has a fixed displacement, the peak and average magnitudes of the crankcase vacuum will vary inversely with the gas volume within the crankcase, or directly as a function of the volume of oil in the crankcase. The crankcase vacuum is not affected by the high agitation of the oil which results in the formation of oil droplets suspended in the crankcase gas and coating the surfaces within the crankcase. It should be noted that the oil droplets are still a noncompressible liquid and not a vapor. The magnitude of the peak and average crankcase vacuum is inversely dependent upon the gas volume in the crankcase, which remains unchanged regardless of where the oil is located.

The invention is directed to a pneumatically operated switch responsive to the average vacuum level in the crankcase of an operating reciprocating piston engine for automatically stopping the engine when the volume of oil in the engine crankcase falls below a predetermined safe level. The engine may be, for example, an internal combustion engine or an air compressor. The switch includes a piston which is reciprocated in a cylinder against a calibrated spring in response to crankcase vacuum. As the piston reciprocates, it is rotated to follow a first path from a first position to a second position as the piston is moved in response to increasing crankcase vacuum during engine start-up and to return on a second path from the second position to the first position during operation and stopping of the engine. The position of the piston along the second path is dependent upon the magnitude of the average engine crankcase vacuum. The position of the piston is calibrated such that when the average vacuum corresponds to a desired shut off oil level, the piston opens or closes an electric switch to interrupt operation of the engine.

It is an object of the invention to provide a pneumatically actuated switch for stopping a reciprocating piston engine when the volume of oil in an engine crankcase is insufficient for proper lubrication.

Other objects and advantages of the invention will be apparent from the following detailed description and the drawings.

BEST MODE FOR CARRYING OUT THE INVENTION

The present invention is directed to a pneumatically actuated switch which determines when there is insufficient oil in the crankcase of an operating reciprocating piston engine for proper lubrication. The operation of the switch is based upon our discovery that the quantity of oil present in the crankcase of relatively small reciprocating piston engines, such as four-stroke reciprocating piston internal combustion engines or reciprocating piston compressors, can be determined by monitoring the vacuum within the crankcase. As the piston reciprocates, the gas pressure within the crankcase pulsates. Above atmospheric pressure gases are vented through a check valve to maintain an average vacuum within the crankcase. This crankcase vacuum reduces oil losses past crankshaft seals and past the piston rings which may occur during the intake stroke, for example, if the crankcase were pressurized.

It will be apparent that the reciprocating piston has a fixed displacement. For any given engine speed, the vacuum established within the crankcase will vary inversely with the volume of gas in the crankcase. Thus, when the crankcase is filled with oil to its maximum operating level, the gas volume in the crankcase is at a minimum and the vacuum will be at a maximum. As the oil volume in the crankcase decreases, the gas volume will increase and the peak and average vacuum will decrease.

Figure 1:
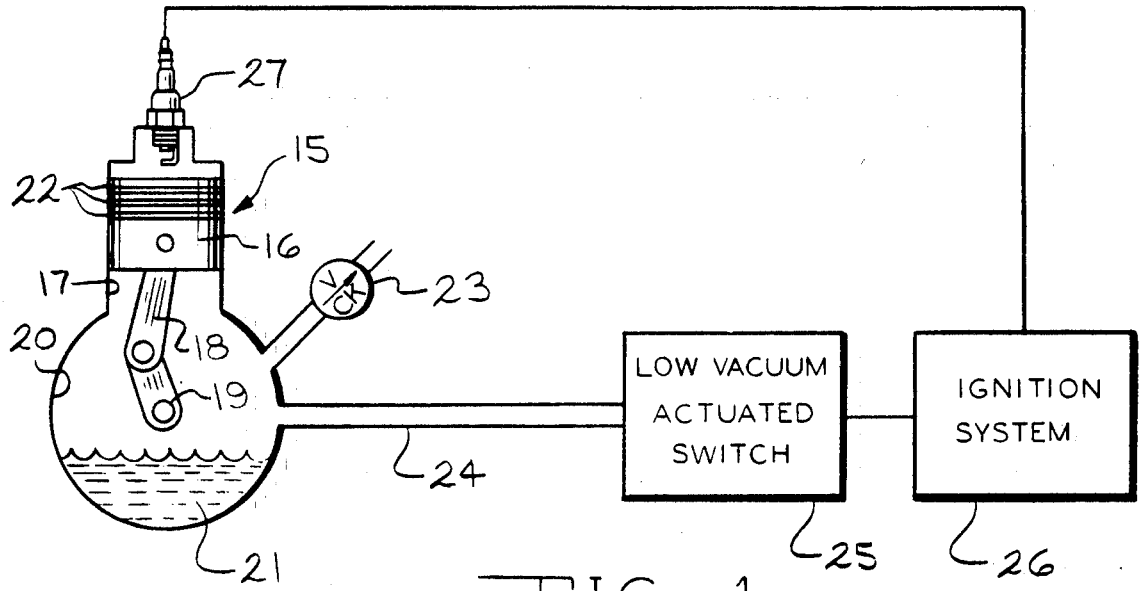
FIG. 1 is a diagrammatic illustration showing a single cylinder reciprocating piston internal combustion engine including a pneumatic switch according to the invention for stopping the engine in response to low crankcase oil.
Figure 2:
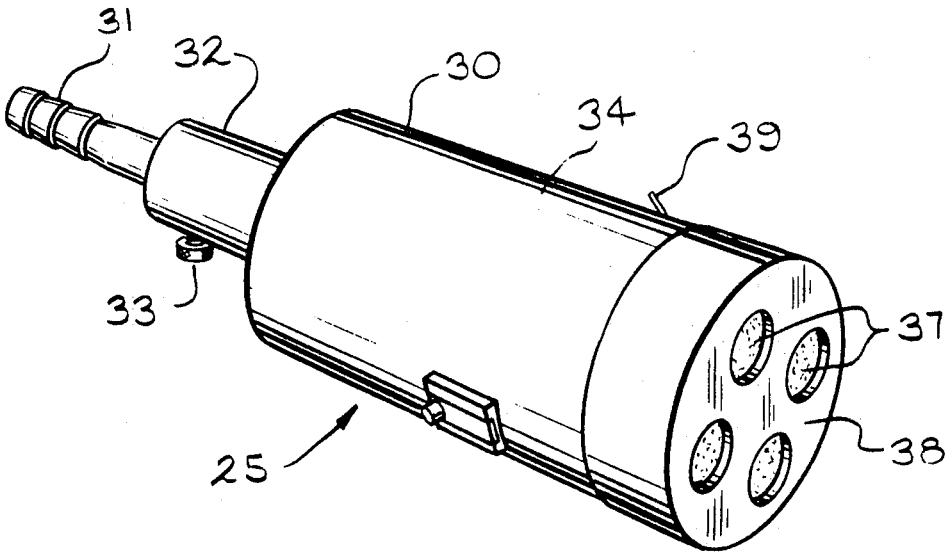
FIG. 2 is a perspective view of the pneumatic switch of the invention.
Figure 3:
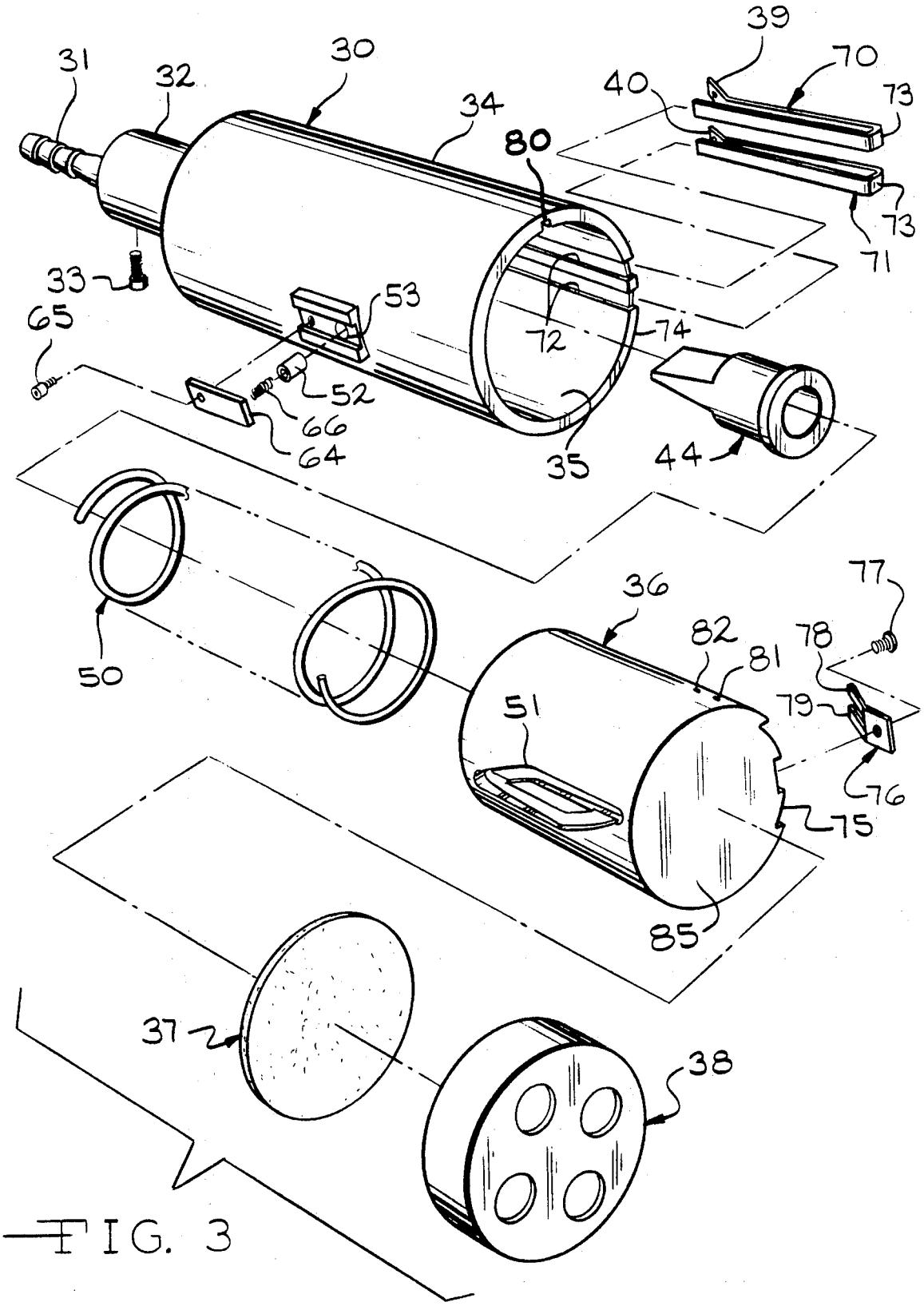
FIG. 3 is an exploded perspective view of the switch of FIG. 2.

FIG. 1 illustrates diagrammatically a spark ignited internal combustion engine 15 of the type having a piston 16 which reciprocates in a cylinder 17. The piston 16 is connected through a connecting rod 18 to a crankshaft 19 which is located in a crankcase 20. The crankcase 20 holds a volume of lubricating oil 21. As the crankshaft 19 rotates during operation of the engine 15, the oil 21 is highly agitated. Small droplets of oil are dispersed in the crankcase gas and coat exposed surfaces within the crankcase 20 to lubricate moving engine parts. Because of the high agitation and the dispersion of the oil, there is no easily measured oil surface or level during engine operation.

As the piston 16 reciprocates in the cylinder 17, there is a cyclic gas pressure in the crankcase 20. If the crankcase is sealed, a cyclic positive or above atmospheric gas pressure will build up in the crankcase due to combustion gases blowing by piston rings 22. Any significant pressure buildup in the crankcase 20 will result in an increased oil consumption. To prevent such a pressure buildup, the crankcase 20 is vented through a check valve 23, which may be of a conventional reed type valve typically found in small engines. The check valve 23 may vent the crankcase either directly to the atmosphere or to an engine air intake (not shown) to reduce air pollution. As a consequence of the check valve 23, the crankcase 20 will have an average vacuum or subatmospheric gas pressure during engine operation. The average crankcase vacuum will be cyclic and will vary from a maximum magnitude when the piston 16 is at the top of its stroke to zero or a slight positive pressure at the bottom of the piston stroke.

A tube 24 is connected from any convenient location on the crankcase 20 above the maximum oil surface level to a pneumatic switch 25 constructed in accordance with the invention. The switch 25 is responsive to the average vacuum in the crankcase 20, which is proportional to the volume of oil in the crankcase. The switch 25 is set to an operating mode during engine start-up. If the average crankcase vacuum drops below a preset level after the switch 25 is set, the switch 25 stops the engine 15, for example, by electrically grounding or electrically open circuiting an engine ignition system 26 to interrupt operation of a spark plug 27. When the engine 15 stops, the loss of crankcase vacuum causes the switch 25 to automatically reset to a starting mode which allows the engine to be restarted.

Referring now to FIGS. 2–7, details are shown for the construction of the switch 25. The switch 25 has a housing 30 preferably formed form a low cost synthetic resinous material which is not subject to attack by engine oil and engine combustion by-products. A connector 31 is formed at one end of the housing 30 for attaching to the tube 24 which connects to the engine crankcase 20. The connector 31 connects to a housing section 32 in which a calibration screw 33 is mounted. The housing section 32 is attached to a larger diameter housing section 34 which defines a cylinder 35 in which a piston 36 reciprocates. The cylinder 35 is closed by an air filter 37 and a perforated cap 38 which is attached to the housing section 34. Switch terminals 39 and 40 extend from the housing section 34 for connection to a circuit (not shown) for stopping an engine in which the switch 25 is installed when there is insufficient lubricating oil in the engine crankcase.

A passage 41 extends through the connector 31 to connect the tube 24 from the engine to a chamber 42 within the housing section 32. The chamber 42 opens directly into the cylinder 35. The calibration screw 33 is threaded into the housing section 32 and extends into the passage 41. The screw 33 forms an adjustable restriction 43 in the passage 41 for controlling the rate of gas flow between the engine crankcase and the switch 25 to calibrate the switch 25 for different engines which have a different average crankcase vacuum level when the crankcase oil volume is at or below an acceptable volume for proper lubrication. Different engines will have different crankcase vacuum characteristics due to differences in piston displacement, in crankcase volume and in oil volume requirements for proper lubrication. It should be appreciated that when the switch 25 is manufactured for a specific engine, the calibration screw 33 may be replaced with a calibrated orifice (not shown), if desired.

A check valve such as a duckbill check valve 44 is mounted in the housing section 32. The valve 44 is molded from a resilient oil resistant material and includes resilient flaps 45 and 46 which are normally abutting to prevent gas flow into a closed chamber 47 defined between the piston 36 and the cylinder 35 and a closed housing end 48 but deflect to allow gas to exit the chamber 47. The valve 44 dampens pulsations in the crankcase vacuum by allowing gas to exit the chamber 47 during vacuum peaks when the crankcase vacuum exceeds the vacuum in the chamber 47, while preventing a reverse gas flow when the crankcase vacuum is less than the vacuum in the chamber 47. It should be appreciated that the valve 44 can be eliminated if an accumulator tank (not shown) is placed between the crankcase and the chamber 47 to average out fluctuations in the vacuum and maintain an average vacuum in the chamber 47 proportional to the average vacuum in the engine crankcase.

The piston 36 is sized to closely engage the cylinder 35 while being free to slide and rotate. A calibrated compression spring 50 is located in the chamber 47 to urge the piston in an axial direction away from the chamber 42 and towards the cap 38. Linear and rotational motion of the piston 36 is restricted by a cam arrangement which includes a stepped cam groove 51 in the exterior surface of the piston 36 and a follower 52 mounted in an opening 53 in the housing section 34.

Figure 9:
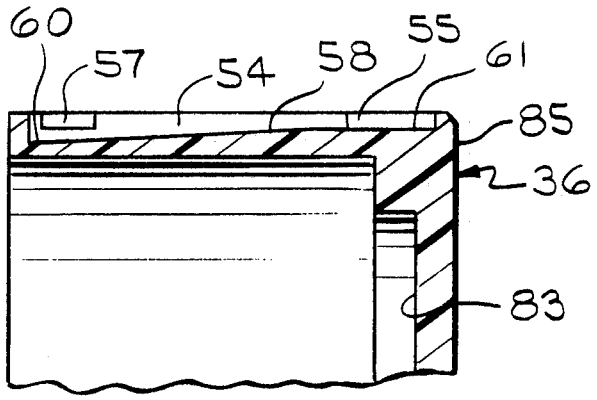
FIG. 9 is a fragmentary cross sectional view of the piston as taken along line 9—9 of FIG. 8 and showing details of the engine starting side of the piston cam.
Figure 10:
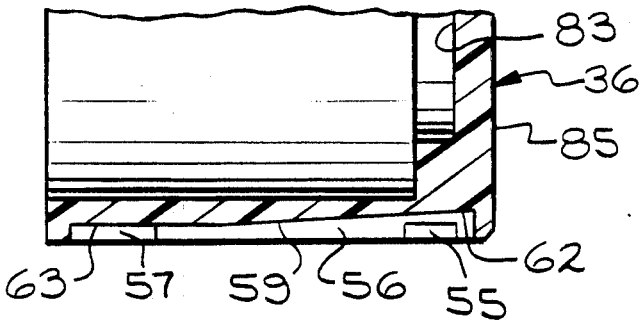
FIG. 10 is a fragmentary cross sectional view of the piston similar to FIG. 9, but showing details of the engine operating side of the piston cam.
Figure 11:
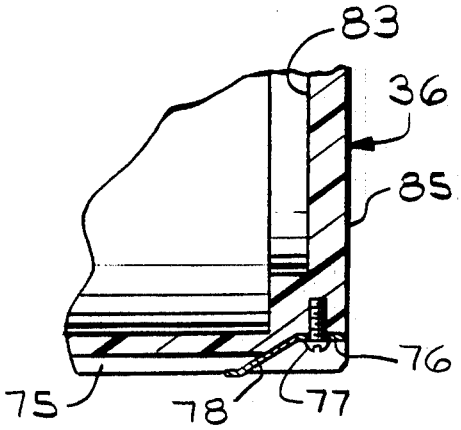
FIG. 11 is a fragmentary cross sectional view of the piston showing details of the contact brush attached to the piston.

The configuration of the cam groove 51 is best seen in FIGS. 4, 5, 8, 9 and 10. The cam groove 51 has four sides 54–57. The sides 54 and 56 are laterally spaced and parallel with the axis of the piston 36 for confining movement of the piston to an axial direction. The sides 55 and 57 are transitions for connecting the sides 54 and 56 and for rotating the piston 36. As best seen in FIG. 9, the cam groove sides 54 and 55 have a sloping bottom 58 which has a maximum depth at 60 where the sides 54 and 57 meet and a minimum depth at 61 where the sides 55 and 56 meet. FIG. 10 shows that the cam groove sides 56 and 57 have a sloping bottom 59 which has a maximum depth at 62 where the sides 55 and 56 meet and a minimum depth at 63 where the sides 57 and 54 meet. Thus, radially directed steps are formed between the groove sides 55 and 56 and between the groove sides 57 and 54.

Figure 6:
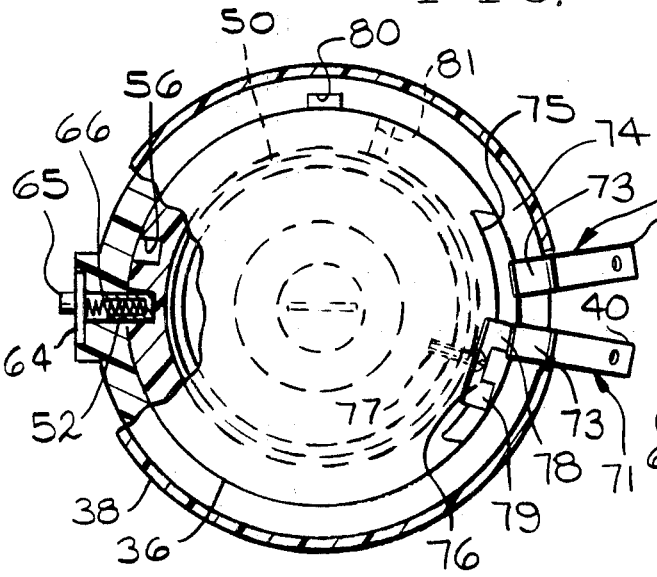
FIG. 6 is a partially broken away cross sectional view taken along line 6—6 of FIG. 5.
Figure 7:
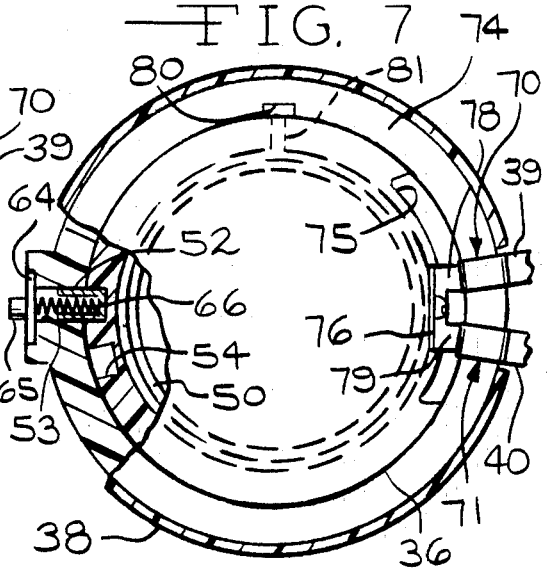
FIG. 7 is a partially broken away cross sectional view taken along line 7—7 of FIG. 4.
Figure 8:
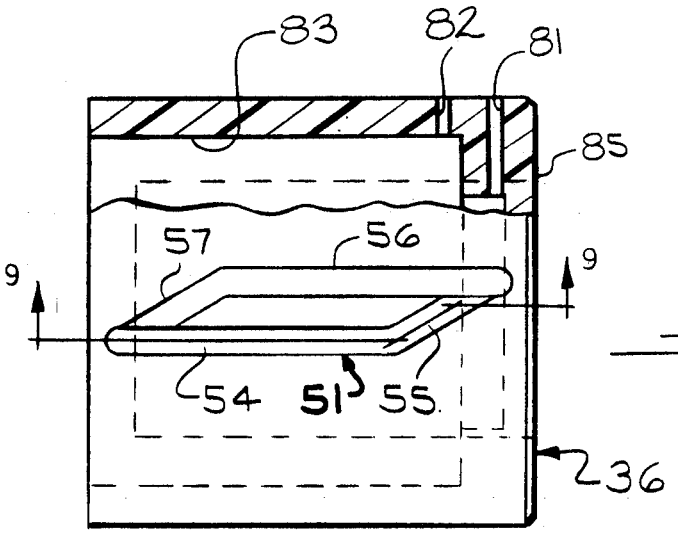
FIG. 8 is a partially broken away side elevational view of the piston for the switch of FIG. 2 showing the cam groove and the vacuum dump ports.

Details of the cam follower 52 are best seen in FIGS. 6 and 7. The cam follower is generally cup shaped and is confined to move in a radial direction in the housing opening 53. The housing opening 53 is closed by a plate 64 which is attached to the housing 30 by a screw 65. A small compression spring 66 is located in the opening 53 between the plate 64 and the cam follower 52 to urge the cam follower 52 radially inwardly against the sloping cam groove bottoms 58 and 59. As the piston 36 reciprocates, the cam follower 52 is stationary, only moving radially inwardly and outwardly as it follows the stepped groove bottoms 58 and 59.

Two electrical switch electrodes 70 and 71 are attached to the housing 30. The electrodes 70 and 71 are mounted in parallel grooves 72 formed in the wall of the cylinder 35 to extend in a direction parallel to the housing axis. The electrodes 70 and 71 are formed, for example, from spring tempered brass and are each formed with a u-shaped bend 73 to extend around an open end 74 on the housing 30 for clamping the electrodes 70 and 71 in the grooves 72. On the outside of the housing 30, the switch electrode 70 terminates at the terminal 39 and the switch electrode 71 terminates at the terminal 40.

Adjacent the electrodes 70 and 71, the piston 36 has a relief area 75 which permits the piston to reciprocate and turn within the motion confines of the cam groove 51 and the cam follower 52 without interference with the electrodes 70 and 71. A generally u-shaped brush 76 is attached by a screw 77 to the piston 36 in the relief area 75, as best seen in FIGS. 3, 6, 7 and 11. The brush 76 has two contacts 78 and 79 which are bent angularly away from the piston 36. The brush contacts 78 and 79 are spaced apart the same distance as the electrodes 70 and 71. The brush 76 is located on the piston so that the contacts 78 and 79 align in an axial direction with the electrodes 70 and 71, respectively, when the cam follower 52 is located either in the cam groove side 56 or in a portion of the cam groove side 57 adjacent the side 56. However, the brush 76 also is located where the contacts 78 and 79 are clear of the electrodes 70 and 71 when the follower 52 is located in the cam groove sides 54 and 55 during initial engine start-up and when the engine is operating with sufficient oil in the crankcase.

Figure 4:
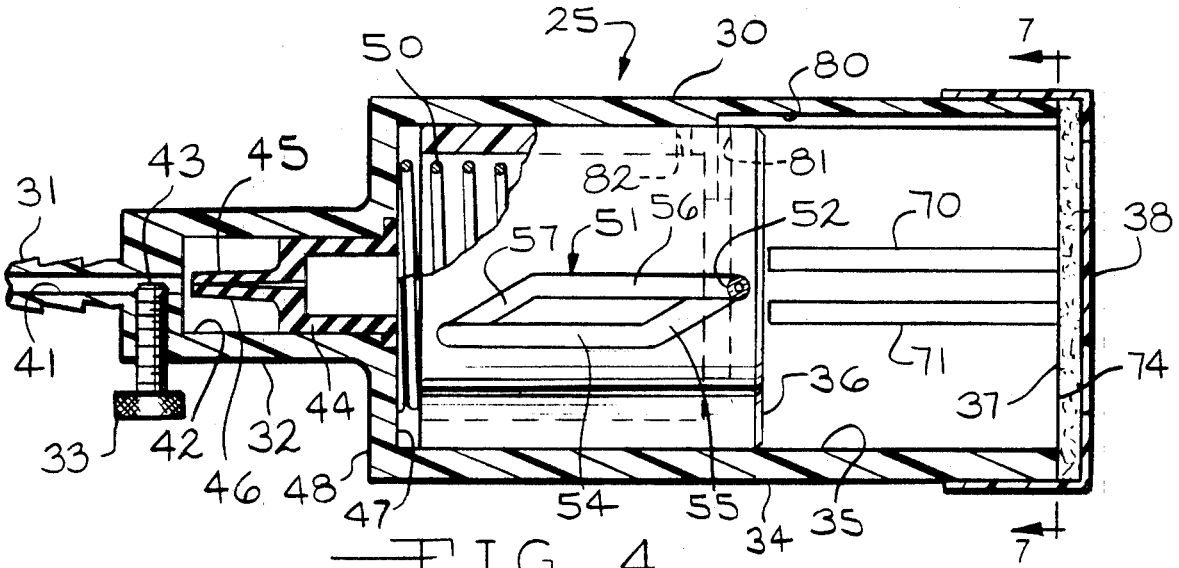
FIG. 4 is a fragmentary cross sectional view through the switch of FIG. 2 showing the piston in the fully retracted position immediately after engine start-up.

A vacuum dump groove 80 also is formed in the wall of the cylinder 35 to extend a predetermined distance from the housing end 74. Two axially spaced vacuum dump ports 81 and 82 are formed through the piston 36 adjacent a piston end 85 to connect the groove 80 through a hollow interior 83 of the piston 36 to the chamber 47, as best seen in FIGS. 5–8. The ports 81 and 82 are located in axial alignment with the groove 80 when the piston is oriented with the cam follower 52 in the cam groove side 56. The vacuum dump port 81 is located to communicate with the vacuum dump groove 80 whenever the cam follower 52 is located in the side 56, as illustrated in FIGS. 4 and 7. The vacuum dump port 82 is located to communicate with the vacuum dump groove 80 when the piston moves to a position corresponding to insufficient crankcase oil. This is the same piston position where electrical contact is initially made between the brush contacts 78 and 79 and the electrodes 70 and 71, respectively.

In operation of an engine in which the switch 25 is installed, the piston 36 reciprocates once in and than out in the cylinder 35 and the cam groove 51 moves one complete cycle or revolution past the stationary cam follower 52 as the engine cycles from start-up to running and is finally stopped. This cycle is the same both when the engine is stopped by an operator and when the engine is stopped by the switch 25 in response to sensing that the crankcase oil is low.

Figure 5:
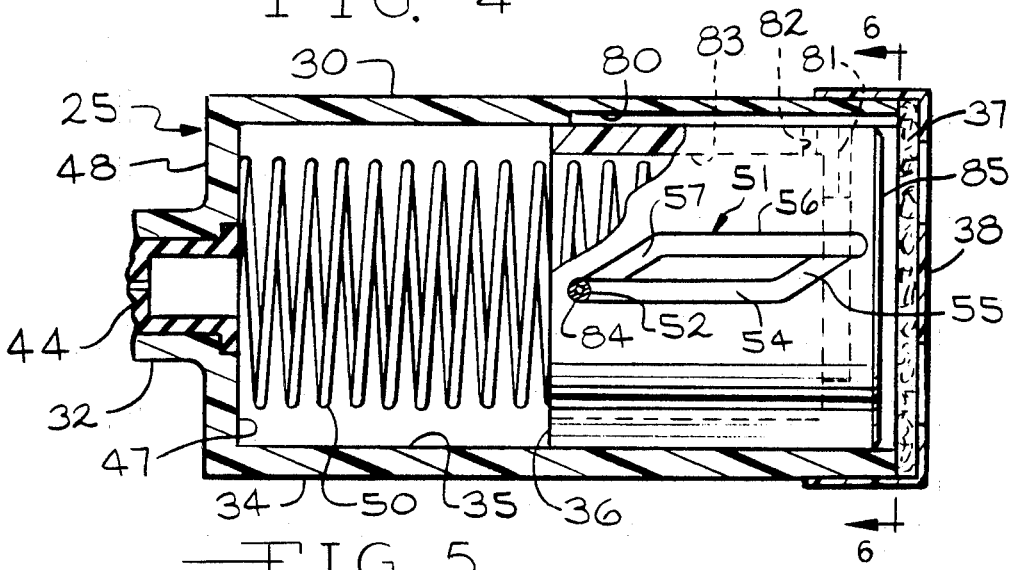
FIG. 5 is a fragmentary cross sectional view, similar to FIG. 4, but showing the piston position when the engine is stopped.

Before the engine is started, the spring 50 moves the piston 36 to the position shown in FIG. 5 with the cam follower 52 located at an initial position 84 at an end of the cam groove side 54. As the engine is started, there is a rapid buildup in the crankcase vacuum since the crankcase is sealed except for the check valve which vents positive pressure, and the piston 36 is pulled into the closed chamber 47 against the pressure of the spring 50. The piston 36 initially moves only in an axial direction as the cam groove side 54 moves past the follower 52. When the follower 52 enters the groove side 55, the piston 36 is rotated as it continues to move in an axial direction. As the groove sides 54 and 55 move past the follower 52, the follower 52 is pushed against the spring 66 by the sloping bottom 58.

The initial start-up vacuum will pull the piston 36 into the cylinder 47 until the follower 52 drops into the groove side 56 at the position shown in FIG. 4. The step between the groove sides 55 and 56 prevents the follower from following the groove side 55 when the piston 35 moves outwardly in the cylinder 35. When the follower 52 moves into the groove side 56, the rotation of the piston 36 aligns the vacuum dump port 81 with the vacuum dump groove 80 and a portion of the vacuum in the chamber 47 is vented. This causes the piston to move slightly outwardly in the cylinder 35. If there is adequate oil in the engine crankcase, the piston 36 will not move to the point that the vacuum dump port 82 communicates with the groove 80 and the brush contacts 78 and 79 contact the switch electrodes 70 and 71. The actual position of the piston 36 in the cylinder 35 is determined primarily by the diameter of the cylinder 35, the properties of the calibrated spring 50, the size of the restriction 43 as determined by the screw 33, and the crankcase vacuum.

When the volume of oil in the crankcase becomes insufficient for adequate lubrication or drops to a predetermined low level, the decrease in crankcase vacuum allows the spring 50 to move the piston 36 in an axial direction in the cylinder 35, as restricted by the cam groove side 56 and the follower 52, until the vacuum dump port 82 connects with the vacuum dump groove 80 and the electrodes 70 and 71 are electrically connected together by the brush 76. The opening of the vacuum dump port 82 is sized to further reduce the vacuum in the chamber 47 so the piston 36 will move further outwardly in the cylinder 35 under the pressure of the spring 50. This assures that the switch electrodes 70 and 71 will remain connected together by the brush 76, even though the crankcase vacuum may remain close to or even go above the level where the electrodes 70 and 71 were first connected. Thus, any increase in crankcase vacuum which can occur as the engine slows down will not move the piston 36 away from the "kill" zone in which the engine is stopped. The switch electrodes 70 and 71 are connected to the engine ignition system to stop or "kill" the engine when they are electrically connected together. The vacuum dump ports 81 and 82 must be sufficiently small that the crankcase vacuum is not dissipated too quickly as the engine slows to a stop. Sufficient vacuum must remain in the crankcase until the engine has stopped to partly retract the piston 36 so that the electrodes 70 and 71 remain connected together by the brush 76 and the engine does not automatically restart. Also, when the cam follower 52 enters the groove 57 as the piston 36 moves towards its initial position, the piston 36 rotates and the vacuum dump ports 81 and 82 are closed. As a consequence, the vacuum in the chamber 47 will take a moment to dissipate when the engine is stopping. After the engine has stopped and as the vacuum in the chamber 47 dissipates, the spring 50 will move the piston until the cam follower 52 drops into the cam groove side 54 at the position 84 shown in FIG. 5. The step between the groove sides 57 and 54 prevents the cam follower 52 from reentering the groove side 57 when the engine is restarted.

During engine start-up, the setting of the calibration screw 33 will have little effect on movement of the piston 36 since the chamber 47 is closed. The initial vacuum in the engine crankcase easily moves the piston 36 against the calibrated spring 50 until the follower enters the cam groove 56. Closing of the vacuum dump ports 81 and 82 when the engine is stopped and during initial startup assures that the piston 36 will move into the operating range with the follower 52 in the cam groove side 56, even when the crankcase vacuum levels are low. At this point, the chamber 47 is vented through the restricted opening 81. A limited flow of ambient air then passes sequentially through the perforated cap 36, the filter 37, the groove 80, the port 81 and into the chamber 47. From the chamber 47, the air flows through the valve 44, past the restriction 43 and through the tube 24 to the engine crankcase. This flow of air during normal engine operation and during engine shutdown assures that the switch 25 will automatically reset when the engine has stopped. For any given crankcase vacuum level, changing the size of the restriction 43 will change the position of the piston when the cam follower 52 is located in the cam groove side 56. By adjusting the screw 33, the threshold crankcase vacuum level at which the switch 25 is closed to stop the engine is calibrated. The switch 25 can be calibrated to stop the engine when any predetermined low quantity of oil is present in the engine crankcase.

It will be appreciated that the above described pneumatic switch has many desirable features. For example, the switch will automatically reset to allow restarting the engine after it is stopped, regardless of whether the engine was stopped by an operator or stopped due to a low oil condition. When the piston 36 moves to the position where the switch is closed to stop the engine, the switch 25 becomes more sensitive to the crankcase vacuum since the vacuum dump port 82 also opens at this point. This assures that the engine will be stopped, even if the crankcase vacuum should vary near the preset threshold point.

The pneumatic switch 25 has been described above for stopping a spark ignited internal combustion engine. It will be understood that the switch may be used with other types of reciprocating engines having a closed sump or crankcase holding a volume of lubricating oil. For example, the switch 25 may be used for stopping a diesel engine by electrically closing a fuel valve when a low oil condition is sensed. Or, the switch 25 may be used with a reciprocating piston compressor by providing a check valve in the crankcase breather opening to maintain an average vacuum in the crankcase. The switch 25 can be connected to a relay which stops the compressor when a low oil condition is sensed. If desired, the switch 25 may actuate an alarm or turn on a warning light or provide some other indication that there is less than a predetermined quantity of oil in the crankcase in addition to or in place of stopping the engine.

It will be apparent to those skilled in the art that the switch electrodes may be arranged in a normally open circuit configuration, as described, or they may be arranged in a normally closed circuit configuration. Also, the location of the electrodes in the housing section 34 can be changed. If desired, the cam follower 52, for example, also may function as one switch electrode and the other switch electrode can be mounted on a portion of the surface of the cam groove 51. Of course, the cam follower 52 can be mounted on the piston and the cam groove 51 can be formed in the wall of the cylinder 35. It also will be apparent that other cam arrangements can be used for providing the desired piston movement during an engine operating cycle. Various other changes and modifications may be made to the above described switch 25 without departing from the following claims.

We claim:

1. A pneumatic switch responsive to the vacuum in a closed crankcase of a reciprocating piston engine, the crankcase containing a volume of lubricating oil, the engine having a check valve connected for venting positive gas pressure from the crankcase to maintain an average vacuum in the crankcase, such vacuum varying as a function of the quantity of oil in the crankcase, said switch indicating when there is less than a predetermined quantity of oil in the crankcase, said switch comprising a housing defining a cylinder with a closed end and a vented end, a piston positioned to slide axially in said cylinder between said closed and vented ends, a spring urging said piston towards said vented end, means for applying vacuum from the engine crankcase to a chamber formed between said piston and said closed housing end to maintain an average vacuum in such chamber whereby the axial position of said piston in said cylinder is determined by the size of said piston, the spring and the vacuum in said chamber, and electric switch means responsive to the position of said piston in said cylinder for indicating when the vacuum in said chamber corresponds to an engine crankcase vacuum when less than the predetermined quantity of oil is in the crankcase.

2. A pneumatic switch responsive to the vacuum in the crankcase of a reciprocating piston engine for indicating when there is less than a predetermined quantity of oil in the crankcase, as set forth in claim 1, and further including a cam and follower interconnecting said piston and said housing, said cam and follower defining a predetermined path of axial and rotational motion for said piston as said piston reciprocates in said cylinder, said piston following at least a first path during engine startup and a second path during engine operation with said piston rotated in said housing between said first and second paths, and wherein said electric switch means is actuated whenever said piston is positioned along a predetermined portion of said second path.

3. A pneumatic switch responsive to the vacuum in the crankcase of a reciprocating piston engine for indicating when there is less than a predetermined quantity of oil in the crankcase, as set forth in claim 2, and further including a vacuum dump groove formed in said housing to extend along a portion of the cylinder, and including a first vacuum dump port located in said piston for venting a portion of such chamber vacuum to said vacuum dump groove when said piston is following said second path.

4. A pneumatic switch responsive to the vacuum in the crankcase of a reciprocating piston engine for indicating when there is less than a predetermined quantity of oil in the crankcase, as set forth in claim 3, and further including a second vacuum dump port located in said piston for venting an additional portion of such chamber vacuum to said vacuum dump groove when said piston is following the predetermined portion of said second path.

5. A pneumatic switch responsive to the vacuum in the crankcase of a reciprocating piston engine for indicating when there is less than a predetermined quantity of oil in the crankcase, as set forth in claim 4, and further including filter means for filtering air passing through said vented end of said housing.

6. A pneumatic switch responsive to the vacuum in the crankcase of a reciprocating piston engine for indicating when there is less than a predetermined quantity of oil in the crankcase, as set forth in claim 5, wherein said means for applying vacuum from the engine crankcase to said chamber includes means for maintaining a vacuum in said chamber corresponding to the average vacuum in the crankcase.

7. A pneumatic switch responsive to the vacuum in the crankcase of a reciprocating piston engine for indicating when there is less than a predetermined quantity of oil in the crankcase, as set forth in claim 6, wherein said means for maintaining a vacuum in said chamber corresponding to the average vacuum in the crankcase comprises a check valve positioned to allow air to flow from said chamber to the crankcase while preventing a reverse air flow.

8. A pneumatic switch responsive to the vacuum in the crankcase of a reciprocating piston engine for indicating when there is less than a predetermined quantity of oil in the crankcase, as set forth in claim 6, wherein said means for applying vacuum from the engine crankcase to said chamber includes an adjustable orifice for restricting the flow of air from said chamber to the crankcase to adjust the predetermined quantity of crankcase oil.

9. A pneumatic switch responsive to the vacuum in the crankcase of a reciprocating piston engine for indicating when there is less than a predetermined quantity of oil in the crankcase, as set forth in claim 1, wherein said means for applying vacuum from the engine crankcase to said chamber includes means for maintaining a vacuum in said chamber corresponding to the average vacuum in the crankcase.

10. A pneumatic switch responsive to the vacuum in the crankcase of a reciprocating piston engine for indicating when there is less than a predetermined quantity of oil in the crankcase, as set forth in claim 9, wherein said means for maintaining a vacuum in said chamber corresponding to the average vacuum in the crankcase comprises a check valve positioned to allow air to flow from said chamber to the crankcase while preventing a reverse air flow.

11. A pneumatic switch responsive to the vacuum in the crankcase of a reciprocating piston engine for indicating when there is less than a predetermined quantity of oil in the crankcase, as set forth in claim 10, wherein said means for applying vacuum from the engine crankcase to said chamber includes an adjustable orifice for restricting the flow of air from said chamber to the crankcase to adjust the predetermined quantity of crankcase oil.

12. A pneumatic switch responsive to the vacuum in the crankcase of a reciprocating piston engine for indicating when there is less than a predetermined quantity of oil in the crankcase, as set forth in claim 1, wherein said electric switch means includes a pair of spaced electrodes attached to said housing to extend along a portion of the cylinder wall in an axial direction, and a brush mounted on said piston at a location for contacting both electrodes when said piston is positioned along said predetermined portion of said second path.

* * * * *